United States Patent [19]

Watanabe

[11] Patent Number: 5,025,763

[45] Date of Patent: Jun. 25, 1991

[54] LATCHING MECHANISM FOR OUTBOARD MOTOR COWLING

[75] Inventor: Eifu Watanabe, Hamamatsu, Japan

[73] Assignee: Sanshin Industries Co., Ltd., Hamamatsu, Japan

[21] Appl. No.: 400,159

[22] Filed: Aug. 28, 1989

[30] Foreign Application Priority Data

Aug. 29, 1988 [JP] Japan ..... 63-214568

[51] Int. Cl.[5] ..... F02B 77/00

[52] U.S. Cl. ..... 123/198 E; 123/195 P; 292/216; 440/77

[58] Field of Search ..... 123/195 P, 198 E; 292/216; 440/76, 77, 78, 84, 88, 113, 900

[56] References Cited

U.S. PATENT DOCUMENTS 4,875,883 10/1989 Skettery ..... 123/195 P
4,932,909 6/1990 Curtis et al. ..... 123/195 P

FOREIGN PATENT DOCUMENTS 59-54400 4/1984 Japan .
59-70900 5/1984 Japan .
60-89375 6/1985 Japan .

*Primary Examiner*—Noah P. Kamen
*Attorney, Agent, or Firm*—Ernest A. Beutler

[57] ABSTRACT

A latching mechanism for connecting the top portion and tray of a cowling which surrounds an internal combustion engine of an outboard motor. In the preferred embodiment, a pair of keepers, one secured to the front side of the top portion of the cowling and the other secured to the rear side of the top portion, engage with a connecting mechanism, secured on the front and rear sides of the tray of the cowling, to connect the top portion and tray of the cowling with each other. An operating lever supported for rotation about a vertical shaft is operatively connected to the connecting mechanism such that rotation of the lever releases the connecting mechanism from the keepers so that the top portion of the cowling can be detached from the tray.

14 Claims, 4 Drawing Sheets

101

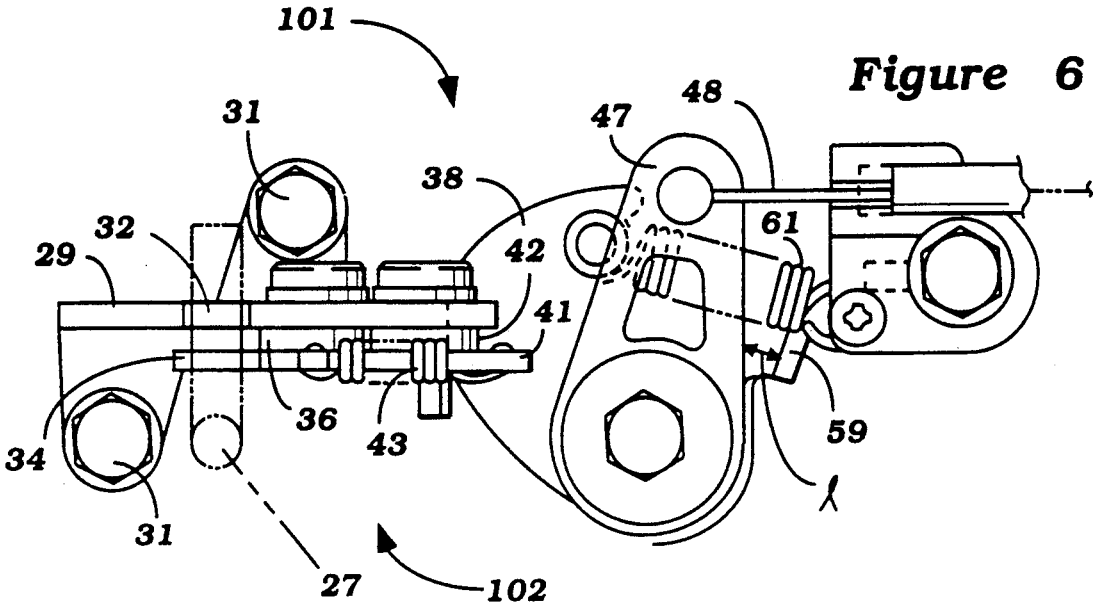
Figure 6
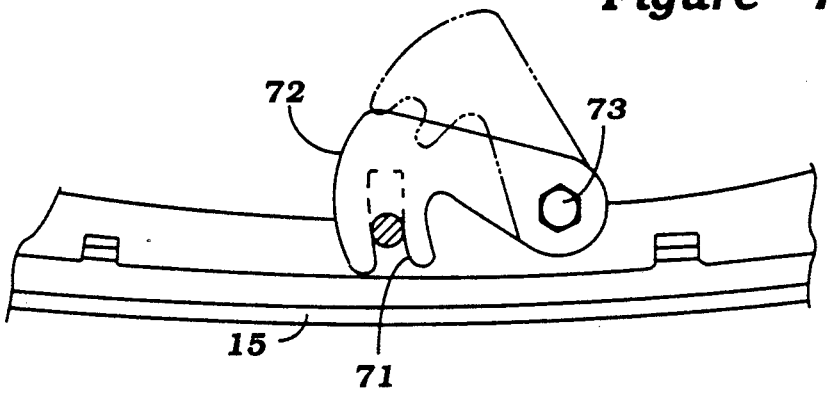
Figure 7
Figure 8
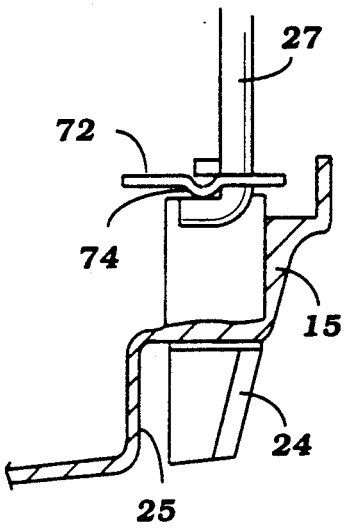
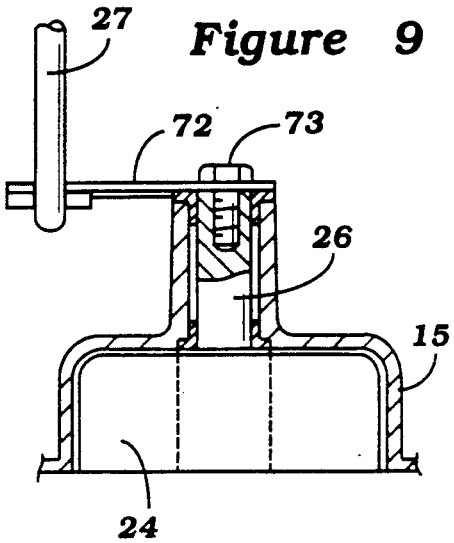
Figure 9

LATCHING MECHANISM FOR OUTBOARD MOTOR COWLING

BACKGROUND OF THE INVENTION

This invention relates to a latching mechanism for a cowling of an outboard motor. More particularly, the invention pertains to a latching mechanism including a connecting mechanism for connecting the top portion and tray of a cowling for the power head of an outboard motor.

It is well known in the art of outboard motors that the powering internal combustion engine is normally enclosed within a cowling so as to provide protection for the engine and a better appearance for the outboard motor. The protective cowling defines a cavity in which the internal combustion engine is contained. In a typical outboard motor the cowling, or at least a top portion thereof, is removable so that the engine can be serviced or repaired.

One form of a latching mechanism for connecting the top and tray portions of the cowling with one another includes an operating lever rotatably disposed about a horizontal shaft for rotating keepers or hooks pivotally secured to one portion of the cowling so as to cause the keepers to engage with corresponding latches secured to the other portion of the cowling. Such a latching mechanism is set forth in laid open and pending Japanese application Nos. 59-70900 and 60-89375. However, such a mechanism is generally difficult to operate due to the small amount of space around the front portion of the cowling where the steering tiller and swivel bracket are typically installed. Because of this lack of space, the lever must be relatively short to avoid interfering with the steering tiller, swivel bracket and other parts around the front portion of the cowling. This makes it difficult for the operating lever to be vertically rotated. Installation of such a mechanism also poses a problem in that it is difficult to form holes for supporting the horizontal shaft which supports the operating lever in the shallow tray-like bottom portion of the cowling.

It is therefore an object of this invention to provide a latching mechanism including an operating lever which is horizontally rotated about a vertical shaft for easy and effective operation to selectively connect or disconnect top and tray portions of the cowling.

It is a further object of this invention to provide a latching mechanism including a vertical shaft about which an operating lever is rotated for disconnecting the top portion from the tray of the cowling thereby eliminating the problems associated with mounting a horizontal shaft.

SUMMARY OF THE INVENTION

The invention comprises a latching mechanism for connecting the top portion and tray of the cowling for a power head of an outboard motor. In one embodiment, this latching mechanism includes a vertical shaft, an operating lever rotatably supported about the shaft, a connecting mechanism including a latch and a fixed plate secured to the cowling, preferably the tray, and at least one keeper secured to the cowling and preferably to the top portion thereof. The keeper is engageable with a recessed portion of the latch and a slot of the fixed plate to connect the top portion and tray of the cowling together. The operating lever is operatively connected to the connecting mechanism such that rotation of the lever releases the connecting mechanism from the keeper so that the top portion of the cowling can be detached from the tray.

A second feature of the latching mechanism includes a vertical shaft, an operating lever rotatably supported about the shaft, a connecting mechanism including two latches and two fixed plates preferably secured to the tray of the cowling, one latch and one fixed plate being secured to the front side of the cowling and the other latch and fixed plate being secured to the rear side, and two keepers preferably secured to the top portion of the cowling, one at the front side and the other at the rear side. The two keepers are engageable with the corresponding latches and fixed plates to connect the top portion and tray of the cowling with each other. The operating lever is operatively connected to the connecting mechanism such that rotation of the lever releases the connecting mechanism from the keepers for detaching the top portion of the cowling from the tray.

In a second embodiment of the invention, the connecting mechanism comprises a stopper plate having a slot which is rotatably secured to a vertical shaft. An operating lever supported for rotation about the shaft is used to rotate the stopper plate so that its slot engages with a keeper to connect the top portion and tray of the cowling with each other.

BRIEF DESCRIPTION OF THE DRAWINGS

FIG. 6 is a top plan view of FIG. 4.

FIG. 7 is an enlarged plan view showing another embodiment of the invention.

FIG. 8 is a left side view of FIG. 7.

FIG. 9 is a right side view of FIG. 7.

DETAILED DESCRIPTION OF THE PREFERRED EMBODIMENTS

Figure 1:
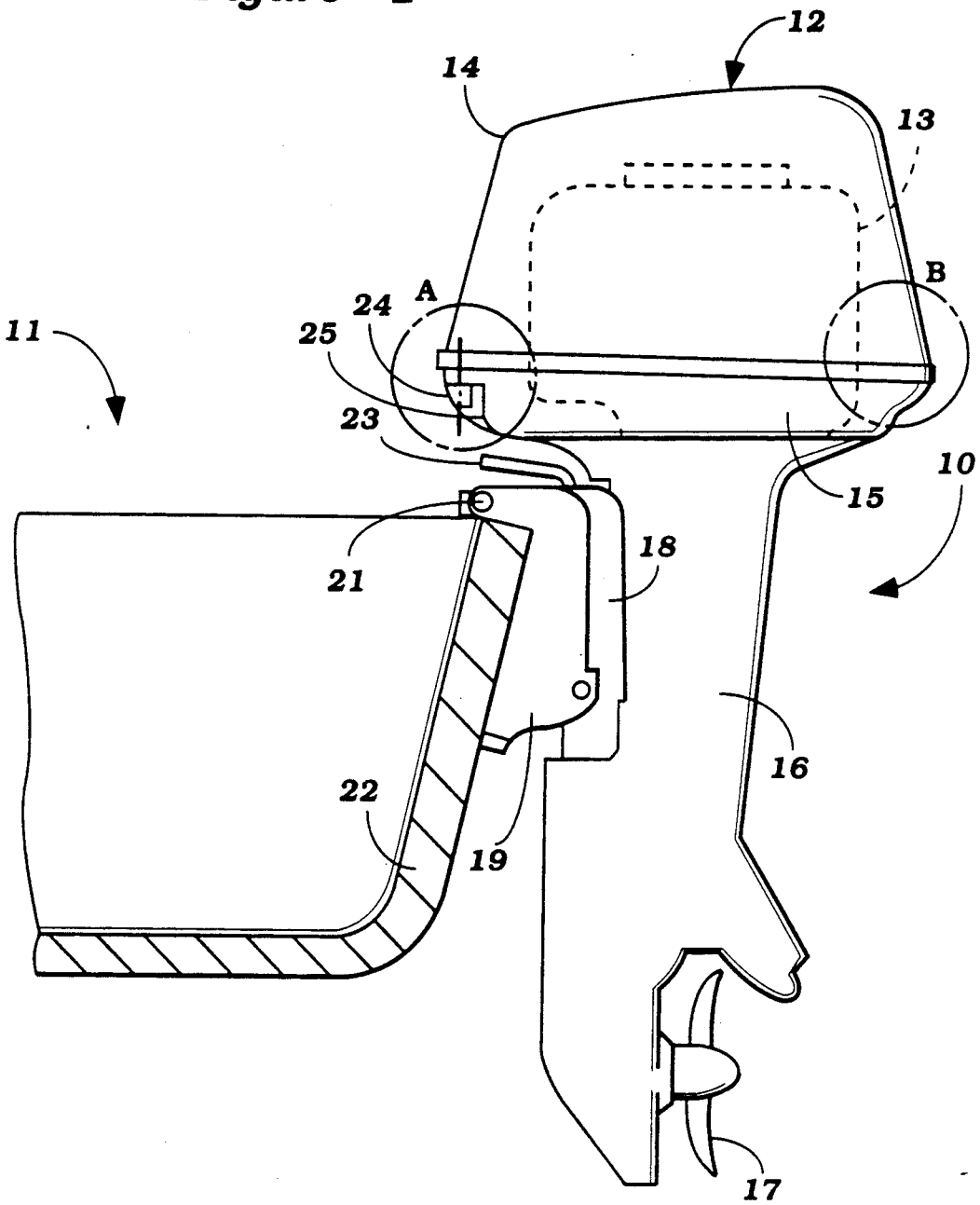
FIG. 1 is a side elevational view of an outboard motor constructed in accordance with the invention.

Referring to FIG. 1, an outboard motor constructed in accordance with the invention is identified generally by reference numeral 10 and is shown as attached to a marine vessel 11. The outboard motor 10 includes a power head, indicated generally by the reference numeral 12, that contains an internal combustion engine 13 and which is surrounded by a protective cowling having a top portion 14 and a bottom or tray portion 15 constructed in accordance with the invention. The top portion of the cowling 14 has a generally inverted bowl shape while the tray portion 15 generally takes the shape of a shallow upright bowl. The internal combustion engine 13 (which is not shown in any detail in the figures and which may be of any known type) drives an output shaft which, in turn, drives a drive shaft that is journaled for rotation within a drive shaft housing 16 that depends from the power head 12. This drive shaft (not shown) drives a propeller 17 of a lower unit by means of a conventional forward, reverse, neutral transmission (not shown).

A steering shaft is affixed to the drive shaft housing 16 in a known manner and is supported for steering movement about a generally vertically extending steering axis within a swivel bracket assembly 18. A steering tiller 23 is provided for steering the outboard motor 10.

The swivel bracket assembly 18 is pivotally connected to a clamping bracket 19 by means of a tilt shaft 21 for tilt and trim movement of the outboard motor 10. The clamping bracket 19 includes means for affixing the outboard motor 10 to a transom 22 of the marine vessel 11. The construction of the outboard motor 10 as thus far described may be considered conventional and, for that reason, those components which are not illustrated and which have not been described in any more detail may take the form of any of the known components used in this field.

In accordance with the invention, a latching mechanism generally indicated by reference numeral 101 (see FIGS. 2 and 3), is provided for connecting the top and tray portions of the cowling, 14 and 15 respectively. This latching mechanism 101 includes an operating lever 24 which is rotatable about a vertical axis, indicated by a phantom line in FIG. 1, for disconnecting the top and tray portions of the cowling, 14 and 15. The operating lever 24 is releasably retained within a recess 25 in the tray portion of the cowling 15 by a spring 61 when not in use. The latching mechanism 101 including the operating lever 24 and its other components are illustrated in more detail on FIGS. 2 through 9.

Referring now in detail to FIGS. 2, 3, 4, 5 and 6, the latching mechanism 101 is comprised of a vertical shaft 26, an operating lever 24 which is rotatably supported about the shaft 26, a connecting mechanism for detachably connecting the top portion of the cowling 14 and the tray portion of the cowling 15 with each other, and first and second keepers 27 and 28. First keeper 27 is secured to the front side of the top portion of the cowling 14 and second keeper 28 is secured to the rear side of the cowling's top portion 14.

Figure 2:
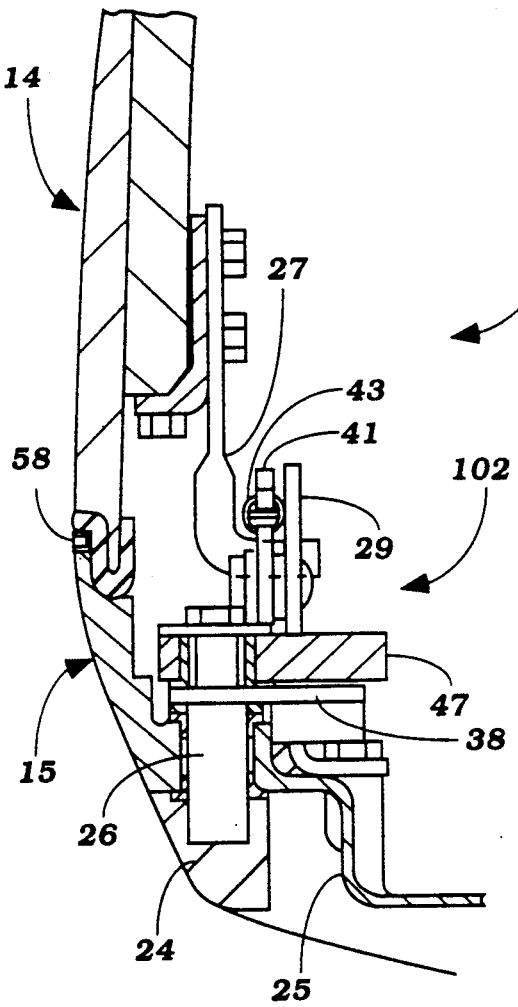
FIGS. 2 and 3 are enlarged cross-sectional views of the portions A and B of FIG. 1, respectively.
Figure 3:
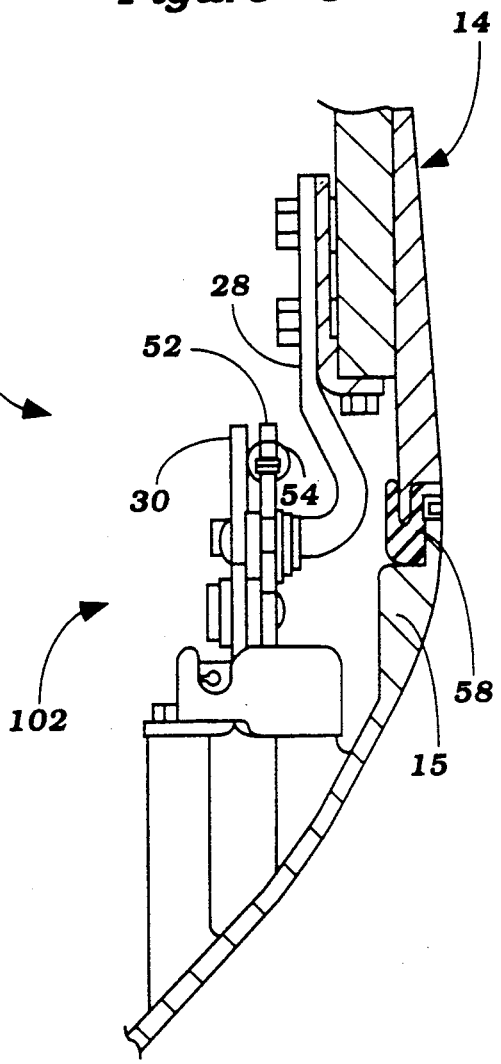
Figure 4:
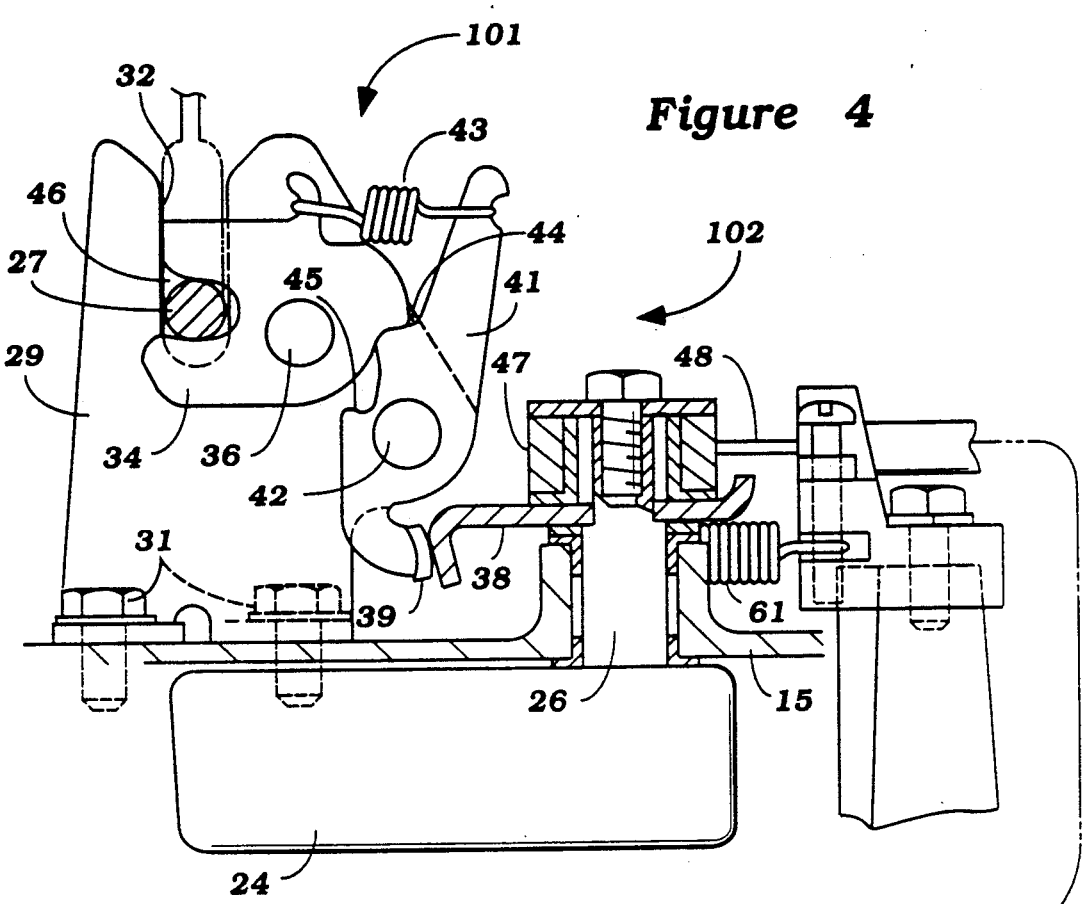
FIGS. 4 and 5 are side views of FIGS. 2 and 3, respectively.

The connecting mechanism includes first and second fixed plates 29 and 30. The first fixed plate 29 is secured to the front side of the tray portion of the cowling 15 and the second fixed plate 30 is secured to the rear side of the tray portion of the cowling 15 by bolts 31 or other suitable securing means. Each of these fixed plates 29 and 30 has a slot 32 or 33 respectively which is engageable with the corresponding keeper 27 or 28 respectively. First and second latches 34 and 35 are provided, the first latch 34 being pivotally secured to the first fixed plate 29 and the second latch 35 being pivotally secured to the second fixed plate 30 by pins 36 and 37 respectively, or other suitable means. Each of these latches 34 and 35 cooperate with their respective fixed plates 29 and 30 to lockingly engage corresponding keepers 27 or 28, as shown in FIGS. 2 through 4, to connect the top portion of the cowling 14 with the tray 15.

To detach the top portion of the cowling 14 from the tray 15 the operating lever 24 is rotated about the vertical shaft 26, causing a cam plate 38 to also rotate about the shaft 26. The rotation of the cam plate 38 exerts a force on a foot 39 of a first rocking lever 41, which is secured to the first fixed plate 29 for pivotal movement by a pin 42, causing the rocking lever 41 to rotate clockwise as seen from the perspective of FIG. 4. As the first rocking lever 41 is rotated clockwise, a spring 43, interposed between the upper end of rocking lever 41 and the upper end of first latch 34, pulls the latch 34 clockwise about the pin 36 so that the first latch 34 is disengaged with a first stepped portion 44 of the first rocking lever 41 and engaged by a second stepped portion 45 of the first rocking lever 41. The clockwise rotation of the first latch 34 renders the first keeper 27 releasable from a recessed portion 46 in the first latch 34 and from the slot 32 in the first fixed plate 29.

The rotation of the cam plate 38 also causes an arm 47 rotatably supported about the shaft 26, to rotate. The cam plate 38 has a claw 59 which is engageable with the arm 47 through a "lost motion" connection and causes the arm 47 to rotate. The distance the claw 59 must travel before engaging the arm 47 is given by the letter 1, as shown in FIG. 6.

A cable 48 is attached at one end to the arm 47 and at the other end to a knob 49 or moveable member engageable with the foot 51 of a second rocking lever 52. The rotation of the arm 47 about the shaft 26 moves the cable 48 and knob 49 toward the arm 47. The knob 49, in turn, exerts a force on the foot 51 of the second rocking lever 52 causing the lever 52 to rotate clockwise, as viewed from the perspective of FIG. 5, about a pin 53 which pivotally secures the second rocking lever 52 to the second fixed plate 30.

Similar to the described operation with respect to the first latch 34 and first rocking lever 41, the rotation of the second rocking lever 52 exerts a force on a spring 54, connecting the upper end of the second latch 35 with the upper end of lever 52, so that the spring 54 pulls the latch 35 clockwise about pin 37. When this occurs, the second latch 35 becomes disengaged with a first stepped portion 55 of the second rocking lever 52 and engages with a second stepped portion 56 of the lever 52. After the second latch 35 rotates, the second keeper 28 can be released from a recessed portion 57 in the latch 35 and from the slot 33 of the second fixed plate 30. When both keepers 27 and 28 are released from the connecting mechanism 102, the top portion of the cowling 14 is unlocked and can be detached from the tray 15.

Figure 5:
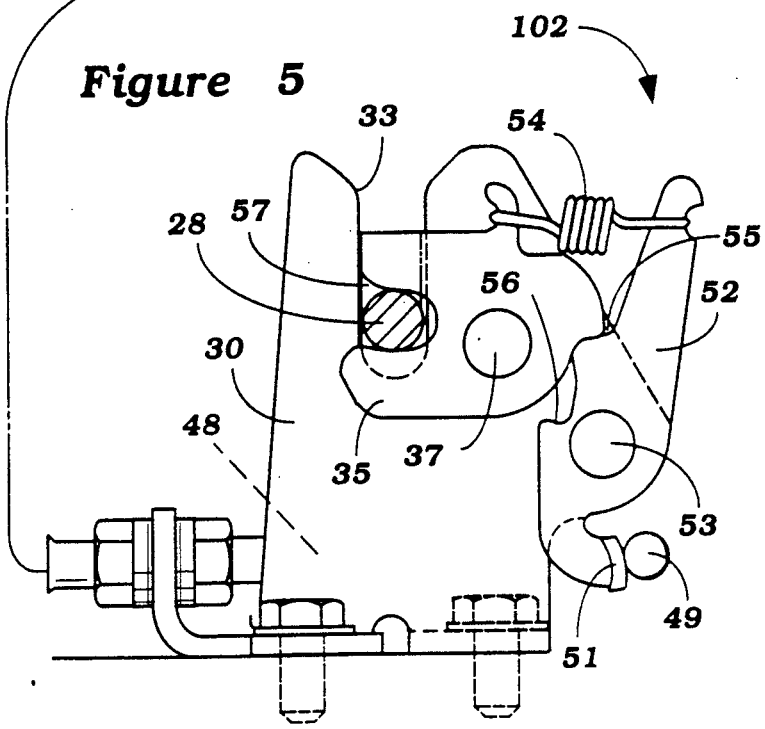

To connect the top portion of the protective cowling 14 with the tray 15, the top portion 14 is placed on the tray 15 so that the keepers 27 and 28 rest in slots 32 and 33 of first and second fixed plates 29 and 30 respectively, and in recessed portions 46 and 57 of first and second latches 34 and 35 respectively. The weight of the top portion of the cowling 14 moves the recessed portions 46 and 57 downward along slots 32 and 33 respectively causing latches 34 and 35 to rotate counterclockwise as viewed from the perspective in FIGS. 4 and 5. The first latch 34 lockingly engages first keeper 27 within the recessed portion 46 of the latch 34 and within the slot 32 of the first fixed plate 29 when the first latch 34 is brought into engagement with the first stepped portion 44 of the first rocking lever 41, as shown in FIG. 4. The second latch 35 lockingly engages second keeper 28 in a similar manner. When the second latch 35 engages with the first stepped portion 55 of the second rocking lever 52, as shown in FIG. 5, the second keeper 28 is lockingly engaged within recessed portion 57 of second latch 35 and within slot 33 of second fixed plate 30. The keepers 27 and 28 are supported and prevented from moving in the horizontal and downward vertical directions by fixed plates 29 and 30 respectively. First and second latches 34 and 35 respectively support keepers 27 and 28 in the vertical direction and prevent keepers 27 and 28 from moving upward as a result of latches 34 and 35 being engaged with first stepped portions 44 and 55 of first and second rocking levers 41 and 52 when lever 24 is not in use. The top and tray portions 14 and 15 of the cowling are then firmly locked together.

A rubber seal 58 is affixed to the lip of the top portion of the cowling 14 to maintain a water tight seal when the top and tray portions 14 and 15 of the cowling are locked together. The operating lever 24 is releasably retained in alignment with the surface of the tray 15 and within recess 25 by the action of spring 61 when the lever 24 is not in use.

FIGS. 7 through 9 illustrate another embodiment of the invention wherein the connecting mechanism 102 comprises an L-shaped stopper plate 72 having a slot 71 which is rotatably secured to the vertical shaft 26 by a bolt 73. In this embodiment, the operating lever 24 is also supported for rotation about the shaft 26 and is used to rotate the stopper plate 72 so that its slot 71 engages with the keeper 27 to connect the top and tray portions of the cowling 14 and 15 with each other. The operating lever 24 is rotated in the opposite direction to disengage the stopper plate slot 71 from the keeper 27 so that two portions of the cowling 14 and 15 can be separated, the top portion 14 being detachable from the tray 15. The stopper plate 72 has a tip portion with a protrusion 74 which engages with the upper surface of the horizontal portion of the keeper 27 to prevent the upward movement of the keeper 27 when the top portion of the cowling 14 is connected with the tray 15.

The foregoing descriptions, represent merely exemplary embodiments of the invention which are highly effective in firmly connecting the top portion and tray of a protective.cowling for an outboard motor. Various changes and modifications may be made without departing from the spirit and scope of the invention, as defined by the appended claims.

I claim:

1. A latching mechanism for connecting the top portion and tray of a cowling for a power head of an outboard motor comprising a shaft, an operating lever rotatably supported about said shaft, a connecting mechanism secured to said cowling and at least one keeper secured to said cowling, said connecting mechanism comprising a latch having a recessed portion engageable with said keeper and a fixed plate having a slot engageable with said keeper to connect the top portion and tray of said cowling with each other, said operating lever being operatively connected to said connecting mechanism such that rotation of said operating lever about said shaft releases said connecting mechanism from said keeper so that the top portion of said cowling can be detached from the tray of said cowling.

2. A latching mechanism as recited in claim 1, wherein said connecting mechanism further comprises a rocking lever having a first stepped portion and a second stepped portion such that said latch is engaged with the first stepped portion of said rocking lever when the top portion and tray of said cowling are connected with each other.

3. A latching mechanism as recited in claim 2, wherein said connecting mechanism further comprises a cam plate rotatably supported about said shaft such that when said operating lever is rotated about said shaft, said cam plate also rotates about said shaft causing said rocking lever to rotate thereby causing said latch to rotate so that said latch is engaged with the second stepped portion of said rocking lever to release said keeper from the recessed portion of said latch and from the slot of said fixed plate.

4. A latching mechanism as recited in claim 3, wherein said keeper is secured to the top portion of said cowling and said connecting mechanism is secured to the tray of said cowling.

5. A latching mechanism as recited in claim 4, wherein when said top portion and tray of said cowling are connected with each other, said keeper is supported in both the vertical and horizontal directions so that the top portion and tray of said cowling are firmly locked together.

6. A latching mechanism for connecting the top portion and tray of a cowling for a power head of an outboard motor comprising a shaft, an operating lever rotatably supported about said shaft, a connecting mechanism secured to said cowling and first and second keepers secured to said cowling, said connecting mechanism comprising first and second latches each having a recessed portion engageable with said first and second keepers respectively to connect the top portion and tray of said cowling with each other, said operating lever being operatively connected to both of said latches such that rotation of said operating lever about said shaft releases both of said latches from said keepers so that the top portion of said cowling can be detached from the tray of said cowling.

7. A latching mechanism as recited in claim 6, wherein said connecting mechanism comprises first and second fixed plates each having a slot, the recessed portion of said first latch and the slot of said first fixed plate being engageable with said first keeper and the recessed portion of said second latch and the slot of said second fixed plate being engageable with said second keeper to connect the top portion and tray of said cowling with each other.

8. A latching mechanism as recited in claim 7, wherein said connecting mechanism further comprises first and second rocking levers each having a first stepped portion and a second stepped portion such that said first latch is engaged with the first stepped portion of said first rocking lever and said second latch is engaged with the first stepped portion of said second rocking lever when the top portion and tray of said cowling are connected with each other.

9. A latching mechanism as recited in claim 8, wherein said connecting mechanism further comprises a cam plate rotatably supported about said shaft such that when said operating lever is rotated about said shaft, said cam plate also rotates about said shaft causing said first rocking lever to rotate thereby causing said first latch to rotate so that said first latch is engaged with the second stepped portion of said first rocking lever to release said first keeper from the recessed portion of said first latch and from the slot of said first fixed plate.

10. A latching mechanism as recited in claim 9, wherein said connecting mechanism further comprises an arm rotatably supported about said shaft, a moveable member engageable with said second rocking lever and a cable attached at one end to said arm and at the other end to said moveable member such that the rotation of said cam plate also causes said arm to rotate about said shaft moving said cable toward said arm causing said second rocking lever to rotate thereby causing said second latch to rotate to release said second keeper from the recessed portion of said second latch and from the slot of said second fixed plate.

11. A latching mechanism as recited in claim 10, wherein said first keeper is secured to the front side of the top portion of said cowling, said second keeper is secured to the rear side of the top portion of said cowling and said connecting mechanism is secured to the tray of said cowling.

12. A latching mechanism as recited in claim 11, wherein when said top portion and tray of said cowling are connected with each other, said keepers are supported in both the vertical and horizontal directions so that the top portion and tray of said cowling are firmly locked together.

13. A latching mechanism for connecting the top portion and tray of a cowling for a power head of an outboard motor comprising a vertical shaft, an operating lever rotatably supported about said shaft, a connecting mechanism secured to said cowling and at least one keeper secured to said cowling, said connecting mechanism comprising a stopper plate having a slot rotatably secured to said shaft, said slot being engageable with said keeper to connect the top portion and tray of said cowling with each other.

14. A latching mechanism as recited in claim 13, wherein said keeper has a substantially horizontal portion having an upper surface and said stopper plate has a tip portion having a protrusion which is engageable with the upper surface of the substantially horizontal portion of said keeper to prevent the upward movement of said keeper.

* * * * *